US010383429B2

(12) United States Patent
Moreau et al.

(10) Patent No.: US 10,383,429 B2
(45) Date of Patent: Aug. 20, 2019

(54) DROP-PREVENTION TOOL HARNESS AND METHOD FOR PISTOL-GRIP HAND TOOLS

(71) Applicant: TY-FLOT, INC., Manchester, NH (US)

(72) Inventors: Darrell A. Moreau, Manchester, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 13 days.

(21) Appl. No.: 15/285,904

(22) Filed: Oct. 5, 2016

(65) Prior Publication Data

US 2018/0084895 A1 Mar. 29, 2018

Related U.S. Application Data

(63) Continuation-in-part of application No. 15/274,196, filed on Sep. 23, 2016.

(51) Int. Cl.

| | |
|---|---|
| ***A45F 5/02*** | (2006.01) |
| ***B25H 3/00*** | (2006.01) |
| *A45F 3/14* | (2006.01) |

(52) U.S. Cl.

CPC ..... *A45F 5/021* (2013.01); *B25H 3/00* (2013.01); *A45F 2003/142* (2013.01); *A45F 2200/0575* (2013.01)

(58) Field of Classification Search

CPC . B25H 3/006; B25H 3/00; A45F 5/021; A45F 2200/0575; A45F 2200/0591; A45F 2200/0566; A45F 2003/142; A45F 2005/006; Y10S 224/904; Y10S 224/911; F41C 33/0245; F41C 33/046; F41C 33/0236

USPC ..... 224/150, 250, 254, 911, 269, 148.5, 224/148.6

See application file for complete search history.

(56) References Cited

U.S. PATENT DOCUMENTS

| | | | | |
|---|---|---|---|---|
| 4,867,359 | A * | 9/1989 | Donovan | A43B 5/0425 224/250 |
| 5,535,928 | A * | 7/1996 | Herring | A45F 5/02 224/250 |
| 5,622,346 | A * | 4/1997 | Story, Jr. | A45F 5/02 224/148.6 |
| 8,011,541 | B2 * | 9/2011 | Mikesell | B25H 3/006 224/250 |
| 2006/0237498 | A1 * | 10/2006 | Piatt, Sr. | A45F 5/02 224/269 |
| 2017/0027308 | A1 * | 2/2017 | Christman | A45F 3/14 |

* cited by examiner

*Primary Examiner* — Scott T McNurlen

(74) *Attorney, Agent, or Firm* — Dicke, Billig & Czaja, PLLC

(57) ABSTRACT

A drop-prevention tool harness for pistol-grip hand tools includes a sleeve member sized to be installed around a gear housing of a pistol-grip hand tool and one or more tool body straps each defining a flattened closed loop that extends around a wall of the sleeve member and extends to a rearward end portion spaced apart from the sleeve member. A tether strap is connected to the rearward end portion of each tool body strap and has first and second tether strap portions that extend to respective first and second tether strap end portions each defining a closed loop. The first closed loop is sized to permit passage therethrough by the second tether strap end portion and cinched against the pistol-grip hand tool.

15 Claims, 12 Drawing Sheets

DROP-PREVENTION TOOL HARNESS AND METHOD FOR PISTOL-GRIP HAND TOOLS

BACKGROUND OF THE INVENTION

1. Field of the Invention

The present invention relates generally to safety accessories for hand tools and more particularly to a drop-prevention apparatus for hand-held power tools having a pistol-grip configuration.

2. Description of the Prior Art

Lanyards, tethers, hooks, and similar restraints are used to prevent accidental dropping of tools. These restraints are particularly useful in environments where a tool drop can cause substantial damage or harm to plant equipment, workers, or objects below a worker who accidentally drops a tool.

One method of restraining tools is to clip one end of a tether to an opening in the handle of a tool (e.g., a D-ring built into the tool's handle) and to clip the other end of the tether to the worker's belt or to a nearby structure. When workers properly tether a tool in this way, accidental drops can be eliminated or greatly reduced. However, due to safety concerns, aesthetic preferences, and to practical design limitations, many hand-held power tools lack attachment points for tethers.

While hand tools without moving parts may have openings or tether-attachment points, powered hand tools often do not. For example, cordless impact drivers and drills include a battery pack attachable to the end of the hand grip. Since it is removable, the battery pack is not an optimal location for a tether attachment point. Also, adding a tether attachment point to the hand grip may not be comfortable during use and it may not look pleasing in sales brochures. Further, manufacturers' concerns about product liability for harm caused by a tether becoming tangled with tool or other equipment lead to the manufacturers eliminating the tether-attachment feature altogether.

The problem of tethering a cordless drill has been addressed in one approach by looping a tether around the handle of the drill in a slip-knot fashion or the like. After looping around the handle, the tether is attached to the user's person or to a nearby structure. To prevent the cord from slipping off of the end of the drill's handle, this approach relies on the difference in size between the hand grip and the larger battery pack or butt of the handle.

Another approach to the problem of tethering a cordless drill is a tool wrap that has a cover formed with large straps and a connector ring. The cover is shaped to loosely slip over the block-shaped battery pack and then is secured to the battery pack by tightening the straps around the battery pack. A first strap is connected at one end of the cover and wraps over the top and around the battery pack in front of the handle. A second strap connects at one end to the front end or "toe" of the cover and wraps horizontally along the side of the battery pack, around the "heel" of the battery pack, and along the opposite side of the battery pack where it connects with hook-and-loop fasteners on the cover. The second strap passes through and retains a connector ring near the "heel" of the battery pack. A tether may be connected to the connector ring.

SUMMARY OF THE INVENTION

Although solutions for tethering a cordless drill with battery pack have been presented, these tethering devices are ill-suited for pneumatic, hydraulic, and corded power tools such as impact drivers and drills since these tools do not have a battery pack. Despite being connected to an electrical cord or supply hose for compressed air or hydraulic fluid, the hand tool still poses a hazard when dropped. In the case of an electrical cord, the cord easily becomes disconnected from an extension cord or from an electrical outlet when the tool is dropped. In the case of hydraulic or pneumatic tools, the supply hose connector is not reliable to retain a dropped tool and the hose often extends to the ground where it is useless to stop the falling tool.

Additionally, the tethering approaches of the prior art are intended for hand tools having a weight of five pounds or less. Reliable tethering devices and methods are not currently available for tools weighing from six to thirty pounds or more. Therefore, an alternative approach is needed to tethering pistol-grip hand tools, such as impact wrenches, drills, riveters, nutrunners, rotary sanders, and other tools having a hand grip that extends transversely down from a generally-horizontal tool body with gear housing, particularly those pistol-grip hand tools having a weight above five pounds. Accordingly, an object of the present invention is to provide a drop-prevention tool harness for hand-held power tools having a pistol-grip extending transversely down from the tool body.

The present invention achieves this and other objectives by providing a drop-prevention tool harness for hand-held power tools having a pistol-grip configuration and a method of tethering a pistol-grip hand tool.

In one embodiment, a drop-prevention tool harness for a pistol-grip hand tool includes a sleeve member extending along a central sleeve axis, where the sleeve member has a sleeve wall and defines an opening sized to be installed around a gear housing of a pistol-grip hand tool. The tool harness also has at least one tool body strap that defines a flattened closed loop that extends around and captures the wall of the sleeve member. Each tool body strap extends to a rearward end portion spaced apart from the sleeve member in a direction generally parallel to the central sleeve axis. A tether strap is connected to the rearward end portion of the tool body strap(s) and has a first tether strap portion extending down from a first side to a first tether strap end portion defining a first closed loop. A second tether strap portion extends down from an opposite second side to a second tether strap end portion defining a second closed loop. The first closed loop is sized to permit passage therethrough by the second tether strap end portion.

In one embodiment, the tool harness has a tool body strap constructed and positioned to extend rearward along the top surface of the pistol-grip hand tool. In other embodiments, the tool harness includes first and second tool body straps configured to extend along the side surfaces of the tool body in addition to or as an alternative to the tool body strap extending along the top surface of the pistol-grip hand tool.

In another embodiment, the tool harness also includes a handle band configured to be installed snugly over the tether strap and a hand grip of the pistol-grip hand tool when the tool harness is installed on the pistol-grip hand tool with the tool body strap extending along the pistol-grip hand tool and with tether strap extending over the top surface of the pistol-grip hand tool, where the first tether strap portion and/or second tether strap portions extend down along the hand grip. In one embodiment, the tether strap cinches around the tool body adjacent the base of the hand grip, where the second tether strap portion extends along the rear or side surface of the hand grip. In another embodiment, the tether strap cinches around the bottom end of the hand grip, where the first tether strap portion extends down one side of the hand grip and the second tether strap portion extends down along the opposite side of the hand grip.

In another embodiment, the tool body strap(s) is (are) adjustable. In another embodiment, the tool body strap defines a rear loop opening distinct from a front loop opening of the flattened closed loop. In another embodiment, the rear loop opening includes a first rear loop opening that captures a rear sleeve member and a second rear loop opening that captures the tether strap.

In some embodiments, the handle band is selected as heat-shrink tubing, rubber tubing provided in an expanded state over a removable core (i.e., "cold-shrink" tubing), elastomeric tubing, an adjustable strap, a length of self-amalgamating tape, or a length of adhesive tape.

In another embodiment, the handle band is a strap fixedly attached to extending transversely from the first tether strap portion or the second tether strap portion. The strap is positioned along the first tether strap portion or the second tether strap portion to be wrapped around a hand grip of the pistol-grip hand tool when the tool harness is installed on the pistol-grip hand tool with the tool body strap extending along a top and/or side surface of the pistol-grip hand tool and the first tether strap portion and/or the second tether strap portion each extending down along the hand grip. For example, the handle band strap includes a first band portion and a second band portion extending in opposite directions from the first tether strap portion or the second tether strap portion.

In some embodiments, one or both of the first closed loop and the second closed loop is a closed-loop connector, such as a D-ring or carabiner.

In another embodiment, the tether strap is fixedly secured to the rearward end portion of the tool body strap(s). In one such embodiment, where the tool harness is installed on a pistol-grip hand tool with the tool body strap extending along a top surface of the pistol-grip hand tool, the first tether strap portion is sized to extend from the tool body strap down along the hand grip with the first closed loop located adjacent a bottom end of the hand grip when the second tether strap end portion passes through the first closed loop.

In another embodiment, the rearward end portion of the tool body strap(s) defines a rear loop opening. A middle portion of the tether strap slidably extends through the rear loop opening, thereby connecting the tether strap to the tool body strap(s) and enabling sliding adjustment of a length of the first tether strap portion relative to the second tether strap portion.

Another aspect of the present invention is directed to a method of tethering a pistol-grip hand tool. In one embodiment, the method includes the steps of providing a pistol-grip hand tool having a tool body with a top surface, a gear housing on a forward end of the tool body, and a hand grip extending transversely down from the tool body; providing a tool harness for drop prevention including (i) a sleeve member sized and constructed to be installed around the gear housing of the pistol-grip hand tool, (ii) one or more tool body straps defining a flattened closed loop that extends around a wall of the sleeve member, where each tool body strap extends to a rearward end portion spaced apart from the sleeve member, and (iii) a tether strap fixedly attached or connected to the rearward end portion of the tool body strap(s) and having a first tether strap portion extending down from a first side of the tool body strap (or from a first tool body strap) to a first tether strap end portion defining a first closed loop and having a second tether strap portion extending down from a second side of the tool body strap (or from a second tool body strap) to a second tether strap end portion defining a second closed loop, where the first closed loop is sized to permit passage therethrough by the second tether strap end portion. The method also includes installing the sleeve member around the gear housing of the pistol-grip hand tool, aligning the tool body strap(s) to extend rearward of the sleeve member along the tool body, positioning the first tether strap portion to extend down along a first side of the pistol-grip hand tool, positioning the second tether strap portion to extend down along a second side of the pistol-grip hand tool; inserting the second tether strap end portion through the first closed loop on the first tether strap end portion; and cinching the tether strap against the pistol-grip hand tool. In some embodiments, the tool body strap is a single strap extending along the top surface of the pistol-grip hand tool. In other embodiments, the tool body strap additionally or alternately includes tool body straps extending along the side surface of the pistol-grip hand tool.

In some embodiments, the step of cinching the tether strap includes positioning the first closed loop against a bottom surface of the tool body adjacent a base of the hand grip and pulling the second tether strap portion through the first closed loop to tighten the tether strap around the tool body. In another embodiment, the step of cinching the tether strap includes positioning the first closed loop against a bottom surface of the hand grip and pulling the second tether strap portion through the first closed loop to tighten the tether strap in a loop around the top surface of the hand tool and the bottom surface of the hand grip.

In another embodiment, the method includes the step of wrapping a plurality of layers of tape around the gear housing prior to installing the sleeve member. The sleeve member is then installed over the taped region, which may define a built-up region or "geometry."

In one embodiment, the providing step includes selecting the sleeve member as heat-shrink tubing and the step of installing the sleeve member includes heating the heat-shrink tubing to cause the shrink tubing to conform to the size and shape of the gear housing.

In another embodiment, the step of providing the tool harness includes selecting the tool harness with each tool body strap defining a rear loop opening, where the tether strap extends through the rear loop opening of each tool body strap.

In another embodiment, the method includes selecting the one or more tool body straps to include a first tool body strap and a second tool body strap and selecting the tool harness to further include a rear sleeve member, where the rear sleeve member extends through the rear loop opening of each of the first tool body strap and the second tool body strap; and positioning the first tool body strap to extend rearwardly along a first side of the tool body; and positioning the second tool body strap to extend rearwardly along an opposite second side of the tool body.

In another embodiment, the method also includes the steps of providing a handle band sized and constructed to be installed around and tightened on the tether strap and the hand grip of the pistol-grip hand tool as the tether strap extends along the hand grip; installing the handle band around the hand grip with the first tether strap portion and the second tether strap portion extending down along opposite lateral sides of the hand grip, where the first tether strap portion and the second tether strap portion each extends between the hand grip and the handle band; and tightening the handle band around the hand grip and the tether strap, thereby restricting movement of the first tether strap portion and the second tether strap portion.

In another embodiment, the step of providing the handle band includes selecting the handle band as heat-shrink tubing, cold-shrink tubing provided in an expanded state over a removable core, elastomeric tubing that can be stretched for installation on the handle, a strap, a length of self-amalgamating tape, or a length of adhesive tape. In one embodiment where the handle band is the cold-shrink tubing provided in the expanded state, the step of tightening the handle band includes removing the removable core to cause the rubber tubing to assume a reduced size and snugly grip the hand grip and tether strap.

In another embodiment, the step of providing the handle band includes selecting a handle band that is fixedly attached to the first or second tether strap portion.

In another embodiment, the handle band is selected as the strap, where the strap extends perpendicularly to the first tether strap portion or the second tether strap portion.

In another embodiment, the method also includes the step of providing a tether having a first tether end and a second tether end, attaching the first tether end to the second closed-loop on the second handle-strap end portion, and attaching the second tether end to the user or to a nearby structure.

In another embodiment, the step of providing the pistol-grip hand tool includes selecting the hand grip to extend down from the tool body at an angle from 90 to 110 degrees.

DETAILED DESCRIPTION OF THE PREFERRED EMBODIMENT

The preferred embodiments of the present invention are illustrated in FIGS. 1-15. As used herein, the terms "up," "down," "forward," "rearward," "top," "bottom," and similar terms refer to the orientation of a pistol-grip hand tool 10 as typically oriented during display or use, where a hand grip 12 extends transversely down from a generally-horizontal tool body 14, and where a gear housing 16 is positioned forward of the hand grip 12 on a forward portion 14*a* of tool body 14. These terms are used for convenience in describing the present invention and do not limit the use or structure of the invention to any specific orientation or use with a particular pistol-grip hand tool 10.

Figure 1:
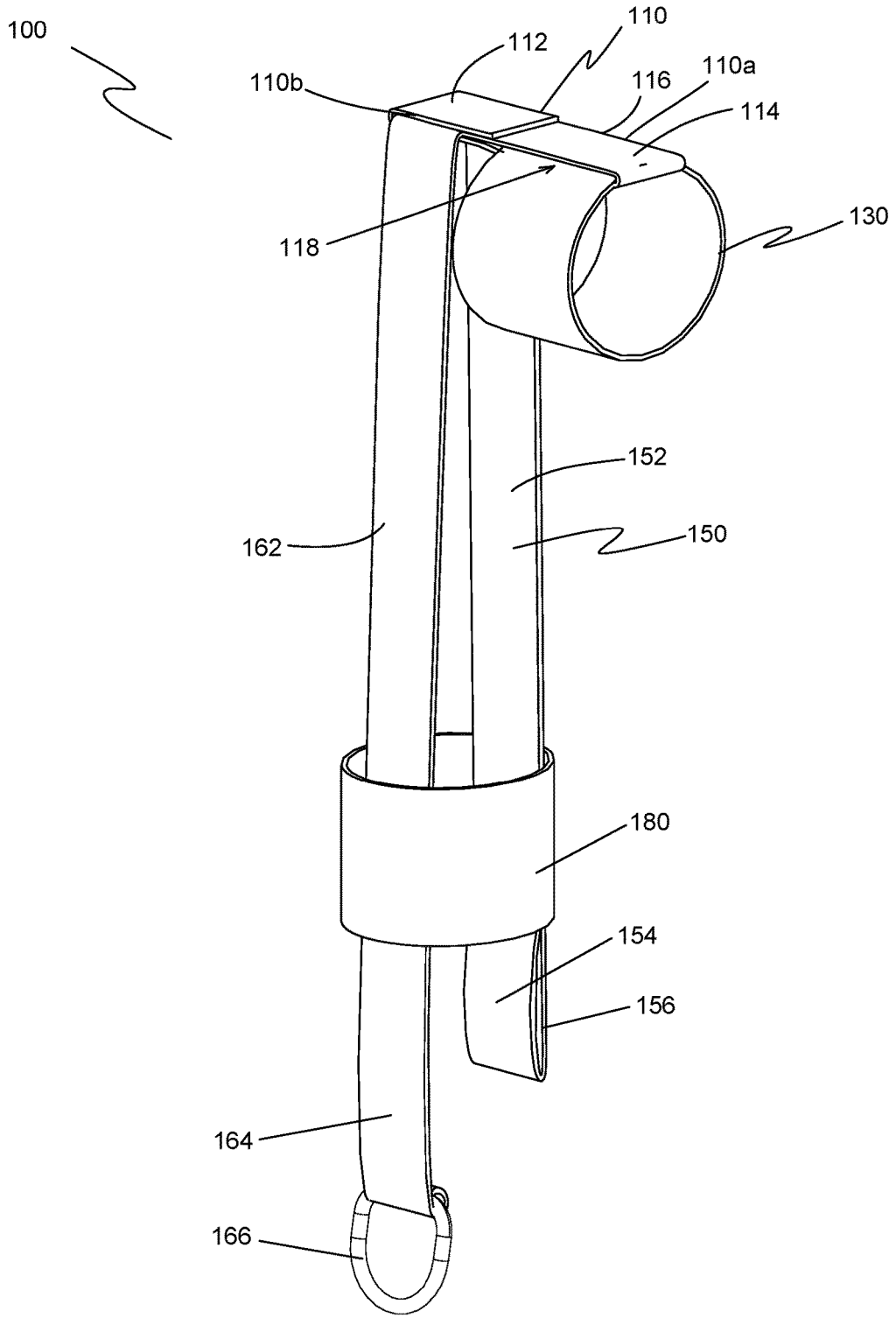
FIG. 1 is a front, top, and side perspective illustration showing one embodiment of a tool harness of the present invention including a sleeve member, a tool body strap, a tether strap, and a handle band.

FIG. 1 illustrates a side, top, and rear perspective view of one embodiment of a tool harness 100 useful for tethering a pistol-grip hand tool 10 (shown, for example, in FIGS. 11-14). Tool harness 100 includes a tool body strap 110 extending generally horizontally, where the tool body strap 110 is configured to extend along a top surface 15 of pistol-grip hand tool 10. Alternately or additionally, tool body strap 110 may be one or more tool body straps 110, such as first and second tool body straps 110', 110" that extend along opposite lateral side surfaces 14*c* of tool body 14. A forward end portion 114 of tool body strap 110 is looped around and captures a sleeve member 130 that is sized to be installed around gear housing 16 of pistol-grip hand tool 10. Sleeve member 130 may be, for example, heat-shrink tubing; rubber tubing provided in an expanded state and supported by a removable core (i.e., "cold-shrink" tubing); rubber tubing, elastomeric tubing, an adjustable strap; a cylindrical sleeve made of plastic, metal, or other rigid or semi-rigid materials; or a flexible sleeve made of fabric, leather, plastic, or the like.

A tether strap 150 is attached to or connected to a rearward end portion 112 of tool body strap 110. Tether strap 150 has a first tether strap portion 152 and a second tether strap portion 162, each of which extends down from opposite sides 110*a*, 110*b* of tool body strap 110, respectively. When installed on pistol-grip hand tool 10, first and second tether strap portions 152, 162 are configured to extend down along opposite lateral sides of pistol-grip hand tool 10. A first tether strap end portion 154 defines a first closed loop 156 and second tether strap end portion 164 defines a second closed loop 166. First closed loop 156 is sized to receive therethrough second tether strap portion 162.

Tool harness 100 optionally includes a handle band 180 that can be installed over and tightened around tether strap 150 and hand grip 12 of pistol-grip hand tool 10. Handle band 180 may be made, for example, of heat-shrink tubing, rubber tubing provided in an expanded state supported by a removable core (i.e., "cold-shrink" tubing), elastomeric tubing, rubber tubing, an adjustable strap, adhesive tape, grip tape, or self-amalgamating tape. When handle band 180 is heat-shrink tubing, for example, handle band 180 is placed in the pre-shrink state over the hand grip and first and second tether strap portions 152, 162 and then heated to cause it to shrink and conform to hand grip 12 with tether strap 150 extending along each side of hand grip 12. When handle band 180 is tape, for example, the tape is wrapped tightly around hand grip 12 and tether strap 150.

Figure 2:
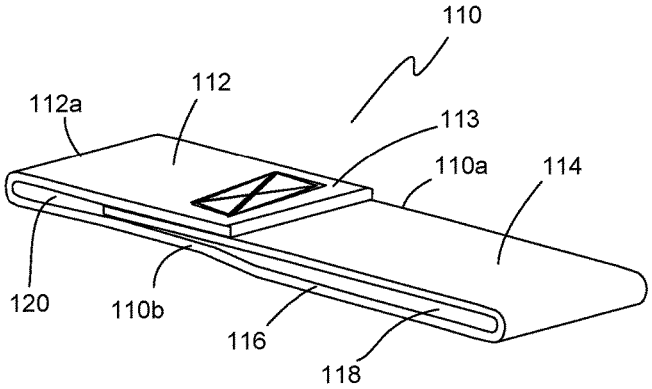
FIG. 2 is a front, top, and side perspective illustration of the tool body strap shown in FIG. 1.

Turning now to FIG. 2, tool body strap 110 of FIG. 1 is shown in a perspective view. Tool body strap 110 extends from rearward end portion 112 to forward end portion 114. Forward end portion 114 defines a front loop opening 118 that is sized to receive wall 131 of sleeve member 130 therethrough, thereby capturing sleeve member 130. In one embodiment, tool body strap 110 is made of flexible material defining a flattened closed loop 116 with front loop opening 118 along forward end portion 114. For example, tool body strap 110 is webbing made of woven or solid nylon, polypropylene, polyester or other material; leather, cloth, metal, or other flexible, semi-flexible, or rigid materials. Preferably, tool body strap 110 is made of flexible materials so that it conforms easily to the shape of the top surface 15 or side surface 14*c* of the tool body 14, but such conformity is not required. In some embodiments, tool body strap 110 is made of rigid material and has a general shape corresponding to top surface 15 or side surface 14*c* of the selected pistol-grip hand tool 10. Optionally, tool body strap 110 is made of a rigid material and is shaped to mate with a specific pistol-grip hand tool 10 or group thereof.

In one embodiment as shown, rearward end portion 112 defines a rear loop opening 120 that is distinct from front loop opening 118. Front and rear loop openings 118, 120 are passageways extending generally perpendicularly to tool body strap 110. In other embodiments, rearward end portion 112 does not define an opening, but instead is an extension of one or more plies of material used to make tool body strap 110, where rearward end portion 112 is secured to tether strap 150. In yet another embodiment, rearward end portion 112 extends as a single ply of material from a middle portion 113 that is folded on itself at rearward end 112*a* to define a catch or stop against which tether strap 150 is positioned.

In one embodiment as shown in FIG. 2, tool body strap 110 is secured to itself at middle portion 113 between front loop opening 118 and rear loop opening 120, such as by stitching, rivets, a grommet, fastener, adhesive, or other suitable means. One use for such a configuration is that front and rear loop openings 118, 120 are separated and distinct from each other, thereby maintaining a spaced-apart orientation of sleeve member 130 and tether strap 150 as it interfaces with tool body strap(s) 110. In other embodiments, tool body strap 110 is made of flexible material that is flattened into an elongated, flattened closed loop with a single loop opening 118.

Figure 3:
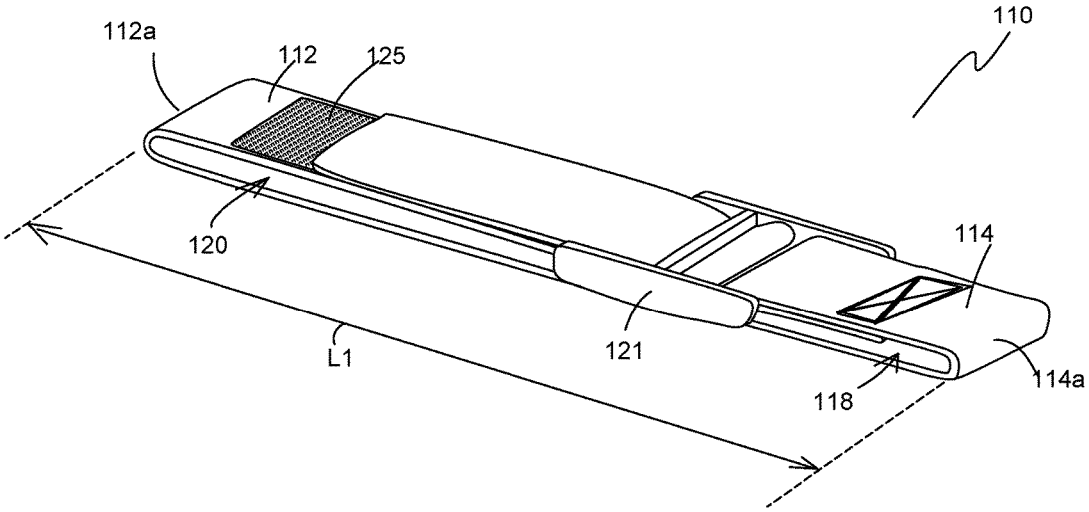
FIG. 3 is a front, top, and side perspective illustration of another embodiment of a tool body strap of the present invention.

Referring now to FIG. 3, another embodiment of tool body strap 110 is shown in a perspective view. Here, tool body strap 110 has an adjustable length L1 between rearward end 112*a* and forward end 114*a*. In one embodiment, a length of webbing is used to form front loop opening 118. In addition to capturing sleeve member 130 (shown in FIG. 1) front loop opening 118 also captures a connector 121 joining front loop opening 118 to rear loop opening 120. In one embodiment, connector 121 is a slider buckle, cam buckle, strap adjustor, roller buckle, closed-loop connector, or other connector permitting adjustment of tool body strap 110. One example of an acceptable connector 121 is the Star Adjuster™ buckle made by Suncor Stainless Inc. of Plymouth, Mass.

As shown, forward end portion 114 loops through connector 121 and is secured to itself to define front loop opening 118 that is permanently closed. Rearward end portion 112 is made of a separate length of webbing that loops through connector 121 and attaches to itself with an attachment member 125. Attachment member 125 is, for example, a hook-and-loop connector, snap button, buckle, snap buckle, clasp, or other device. The user may adjust the length L1 of tool body strap 110 as needed to appropriately position rear loop opening 120 for tether strap 150 on pistol-grip hand tool 10. In other embodiments, a single length of webbing is used to make tool body strap 110 with connector 121 and define front loop opening 118 and rear loop opening 120.

Figure 4:
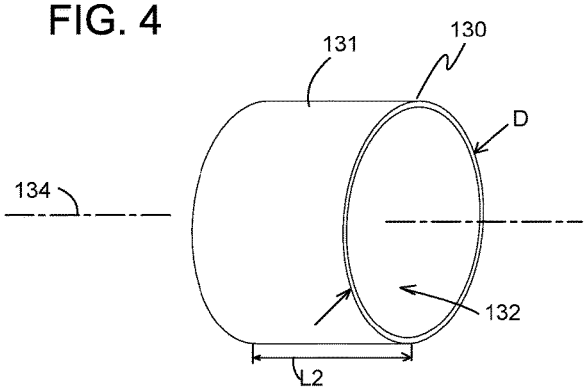
FIG. 4 is front, top, and side perspective illustration of the sleeve member shown in FIG. 1.

Referring now to FIG. 4, one embodiment of sleeve member 130 is illustrated in a side and front perspective view. Sleeve member 130 defines or can be made to define a closed loop with a through-passageway 132 extending along a central sleeve axis 134. Sleeve member 130 has a wall 131 that extends through front loop opening 118 of tool body strap 110. Central sleeve axis 134 is generally horizontal. In one embodiment, sleeve member 130 is made of heat-shrink tubing, cold-shrink tubing, or rubber tubing. For example, sleeve member 130 is heat-shrink tubing that reduces in size when heated. In another example, sleeve member 130 is cold-shrink tubing provided in an expanded state supported by a removable core, where the cold-shrink tubing assumes a smaller size when the core is unraveled and removed from the tubing. In another example, sleeve member 130 is elastomeric or rubber tubing that can be stretched by the user to fit over gear housing 16. In yet another embodiment, sleeve member 130 is an adjustable flexible strap that can be wrapped around gear housing 16. For example, the flexible strap is a length of nylon or other webbing with a releasable fastener, where the webbing can be wrapped around gear housing 16 of pistol-grip hand tool 10 and tightened for a snug fit to gear housing 16. The releasable fastener may be, for example, hook-and-loop fastener, a buckle, two D-rings, a slider buckle, or some other fastener. In yet another embodiment, sleeve member 130 is a length of tape, such as self-amalgamating tape, that is looped in a plurality of overlapping wraps around gear housing 16 while also passing through front loop opening 118 of tool body strap(s) 110. In still other embodiments, sleeve member 130 is a metal or plastic tube or two-piece collar, such as a two-piece clamshell-type shaft collar or the like.

When sleeve member 130 is shrink tubing, the shrink tubing is sized to snugly fit on and grip gear housing 16 when it assumes a reduced size. In one exemplary embodiment intended for an impact wrench, sleeve member 130 is heat-shrink tubing having a length L2 of about 1.75" and a diameter D of about 3" before heat treatment. After installation, the heat-shrink tubing shrinks to snugly engage gear housing 16, which has a length of about 2.25" and diameter of 2.5".

Figure 5:
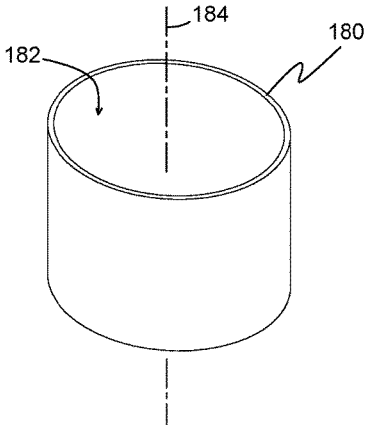
FIG. 5 is a front, top, and side perspective illustration of the optional handle band shown in FIG. 1.

Turning now to FIG. 5, one embodiment of optional handle band 180 as shown in FIG. 1 is illustrated in a perspective view. Similar to sleeve member 130, handle band 180 defines or can be made to define a closed loop with a through-passageway 182 extending along a central handle-band axis 184. When installed, central handle-band axis 184 is generally parallel to hand grip 12 of pistol-grip hand tool 10 (shown, for example, in FIGS. 11-14). Handle band 180 may be made of heat-shrink tubing, cold-shrink tubing, a flexible and adjustable strap, a wrap, a length of tape, a metal band, and the like. Since handle band 180 is spaced further from moving parts of pistol-grip hand tool 10 than sleeve member 130, a strap or length of webbing may be considered more appropriate for handle band 180 than for sleeve member 130 due to safety considerations.

Handle band 180 is often a separate component from tether strap 150 for ease of installation, but may be fixedly attached to or retained by one or both of first tether strap portion 152 and second tether strap portion 162. For example, handle band 180 is secured permanently or temporarily to second tether strap portion 162 by stitching, adhesive, or other means. In another example, handle band 180 extends through a loop defined by second tether strap portion 162.

Figure 6:
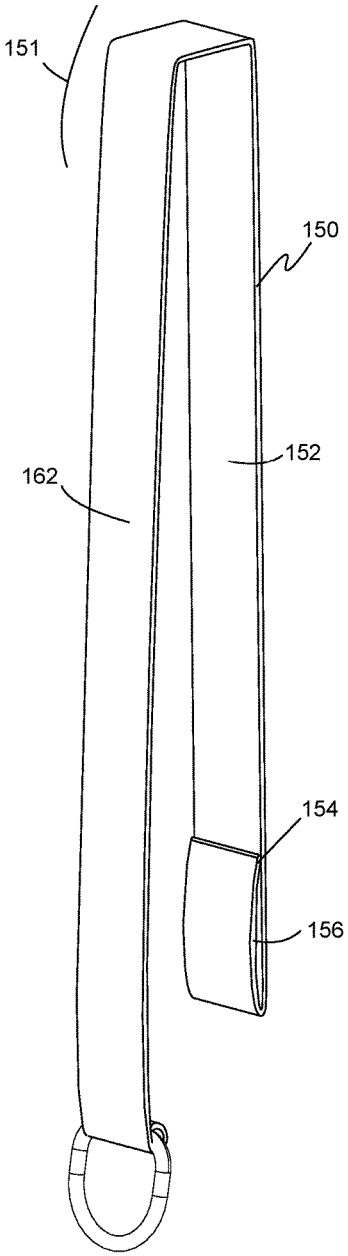
FIG. 6 is a front, top, and side perspective illustration of the tether strap shown in FIG. 1.

Referring now to FIG. 6, a perspective view illustrates one embodiment of tether strap 150 that includes first tether strap portion 152 and second tether strap portion 162 extending in a spaced-apart, generally parallel relationship down from tether strap middle portion 151, which extends over top surface 15 of tool body 14 (shown in FIGS. 11-14). Tether strap middle portion 151 extends through rear loop opening 120 (when present) or may be secured to rearward end portion 112 of tool body strap(s) 110. In some embodiments, tether strap 150 extends unsecured through rear loop opening 120 so that the relative position of first tether strap end portion 154 and second tether strap end portion 164 can be adjusted. In another embodiment, tether strap middle portion 151 is secured to rearward end portion 112 of tool body strap 110, such as by stitching.

First tether strap end portion 154 defines first closed loop 156 and second tether strap end portion 164 defines second closed loop 166, where second tether strap end portion 164 can pass through first closed loop 156. First closed loop 156 and second closed loop 166 may be or may include a closed-loop fastener (e.g., a D-ring or carabiner), may be a loop formed by first or second tether strap end portion 156, 166 fixedly attached to itself, or may be an opening defined in first and/or second tether strap end portion 156, 166 (e.g., a slit, hole, or opening with another shape).

In one embodiment, tether strap 150 is made of flexible material, such as webbing made of woven or solid nylon, polypropylene, polyester or other material; leather, cloth, plastic, or other flexible or semi-flexible materials.

Figure 7:
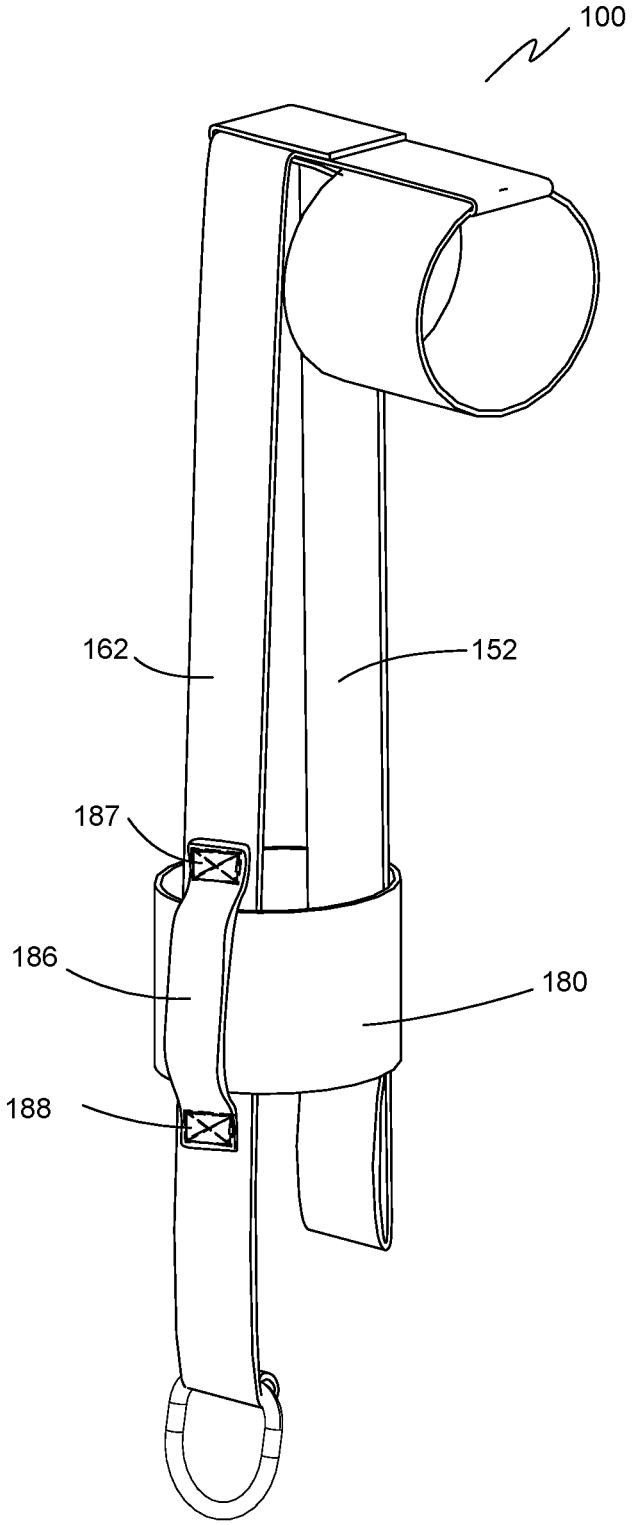
FIG. 7 is a front, top, and side perspective illustration of another embodiment of a tool harness of the present invention showing a loop on the second tether strap portion capturing the handle band.

Referring now to FIG. 7, a perspective illustration shows another embodiment of tool harness 100 where handle band 180 is retained by a loop 186 attached to second tether strap portion 162. As shown, loop 186 is formed by a length of webbing stitched at each end 187, 188 to second tether strap portion 162 with handle band 180 passing through loop 186. Loop 186 could similarly be defined by a metal strap guide or other hardware. Handle band 180 could alternately or additionally be retained by or attached to first tether strap portion 152.

Figure 8:
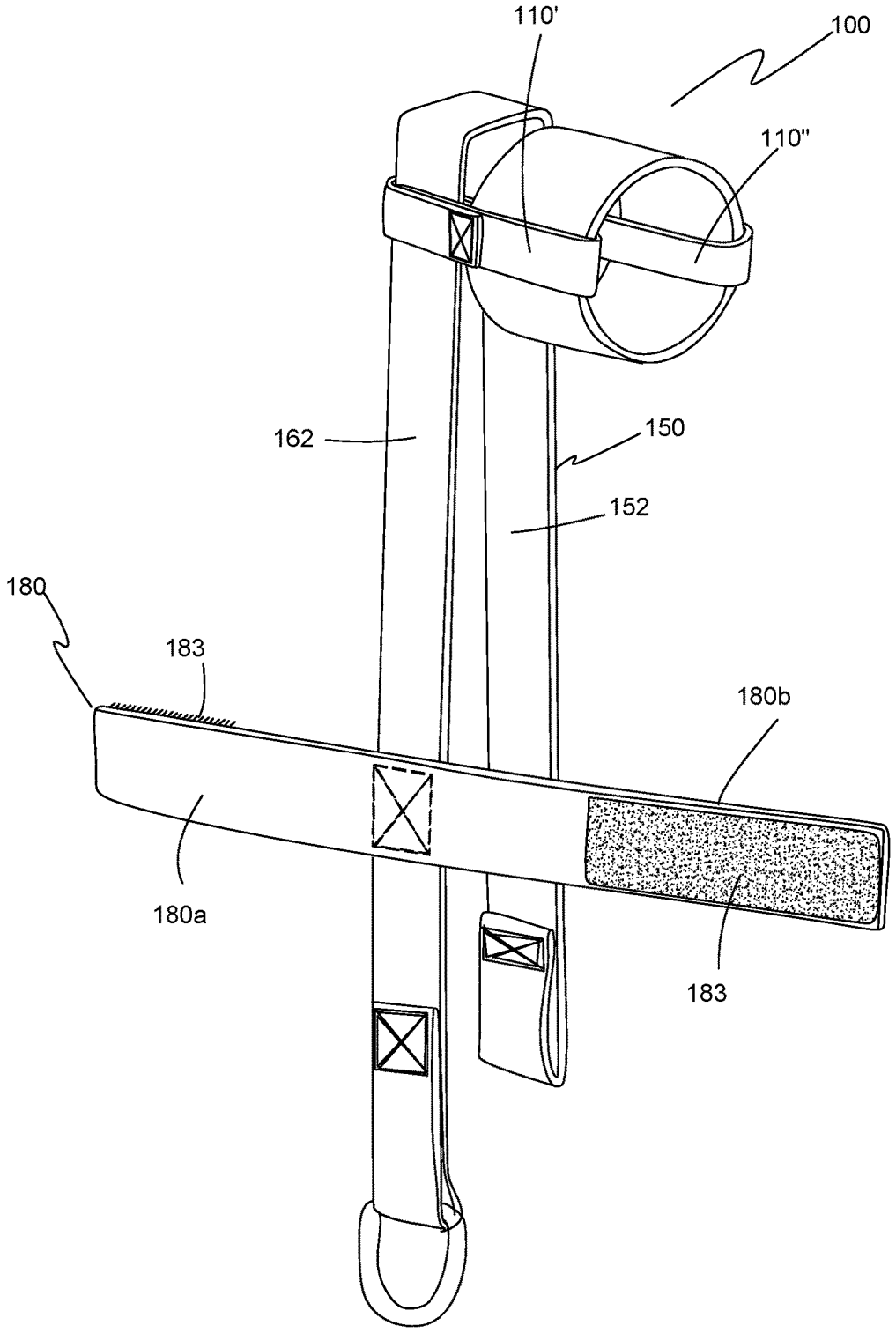
FIG. 8 is a front, top, and side perspective illustration of another embodiment of a tool harness of the present invention showing a handle band configured as a strap that is attached to the second tether strap portion and showing first and second tool body straps positioned to extend along opposite side surfaces of the hand tool.

Referring now to FIG. 8, a perspective view illustrates yet another embodiment of tool harness 100 where tether strap 150 includes optional handle band 180 configured as a strap secured to second tether strap portion 162. In this embodiment, handle band 180 is configured as a strap that is fixedly attached by stitching to second tether strap portion 162 and extends transversely (e.g., perpendicularly) to second tether strap portion 162. Handle band 180 extends substantially perpendicularly to second tether strap portion 162 and is sized to wrap around hand grip 12 of pistol-grip hand tool 10 and secure to itself using a fastener 183. For example, handle band 180 is a length of nylon webbing with a hook-and-loop fastener 183 or other fastener 183 such as a snap, button & button hole, buckle, and the like. In one embodiment, handle band 180 includes a first band portion 180*a* and a second band portion 180*b* extending in opposite directions from first or second tether strap portion 152, 162.

As also shown in FIG. 8, first and second tool body straps 110' 110" each capture sleeve member 130 and are configured to extend along the opposite side surfaces 14*c* of tool body 14. In this embodiment, a first tool body strap 110' is configured to extend along a first side surface 14*c* (e.g., the right side) and a second tool body strap 110" is configured to extend along an opposite side surface 14*c* (e.g., the left side) of tool body 14. This embodiment is particularly useful when sleeve member 130 is made of metal or plastic, where first and second tool body straps 110', 110" extend along opposite side surfaces 14*c* of tool body 14. First and second tool body straps 110', 110" may be used in addition to or in place of tool body strap 110 extending along top surface 15 of pistol-grip hand tool 10 as shown, for example, in FIGS. 11-14.

Figure 9:
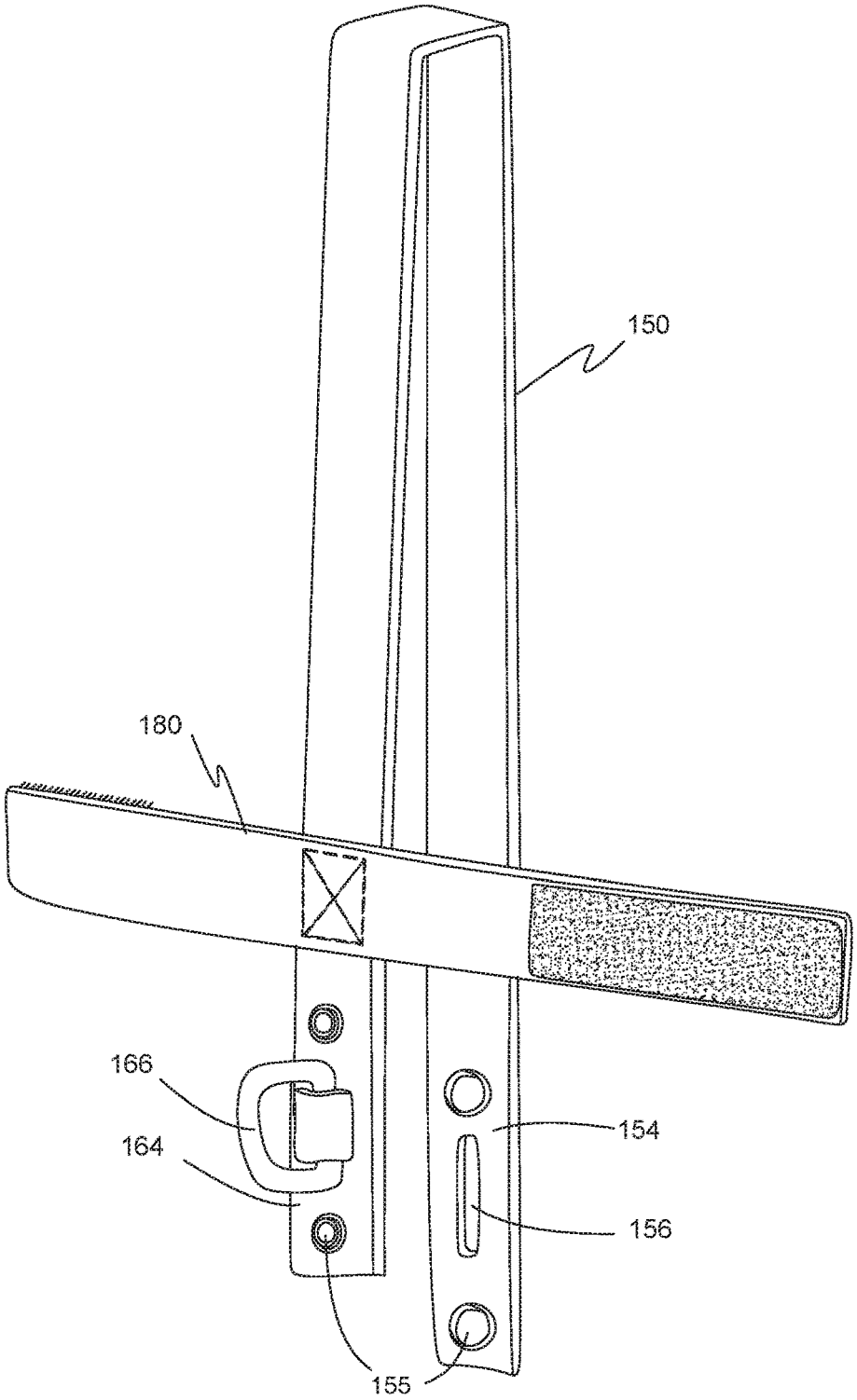
FIG. 9 is a front, top, and side perspective illustration of another embodiment of a tether strap showing a first tether strap end portion with a slot and a second tether strap end portion with the D-ring that inserts through the slot in the first tether strap end portion.

Referring now to FIG. 9, a perspective view illustrates yet another embodiment of tether strap 110, where first tether strap end portion 154 and second tether strap end portion 164 are configured to extend around a bottom end 12*a* of hand grip 12 of pistol-grip hand tool 10 and attach to each other using fasteners 155. Similarly, first tether strap end portion 154 and second tether strap end portion 164 may cinch around tool body 14 adjacent a base 12*b* of hand grip 12 as shown, for example, in FIGS. 13-14. First closed loop 156 is a slot in first tether strap end portion 154 that receives therethrough second closed loop 166 (a D-ring) when first and second tether strap end portions 154, 164 overlap. Accordingly, tether strap 150 defines a closed loop extending around top surface 15 of tool body 14 and bottom end 12*a* of hand grip 12 or bottom surface 14*b* of tool body 14. For example, first tether strap end portion 154 wraps around bottom end 12*a* and overlaps and attaches to second tether strap end portion 164 with fastener 155, such as snaps, a hook-and-loop fastener, or some other fastener 155.

Figure 10:
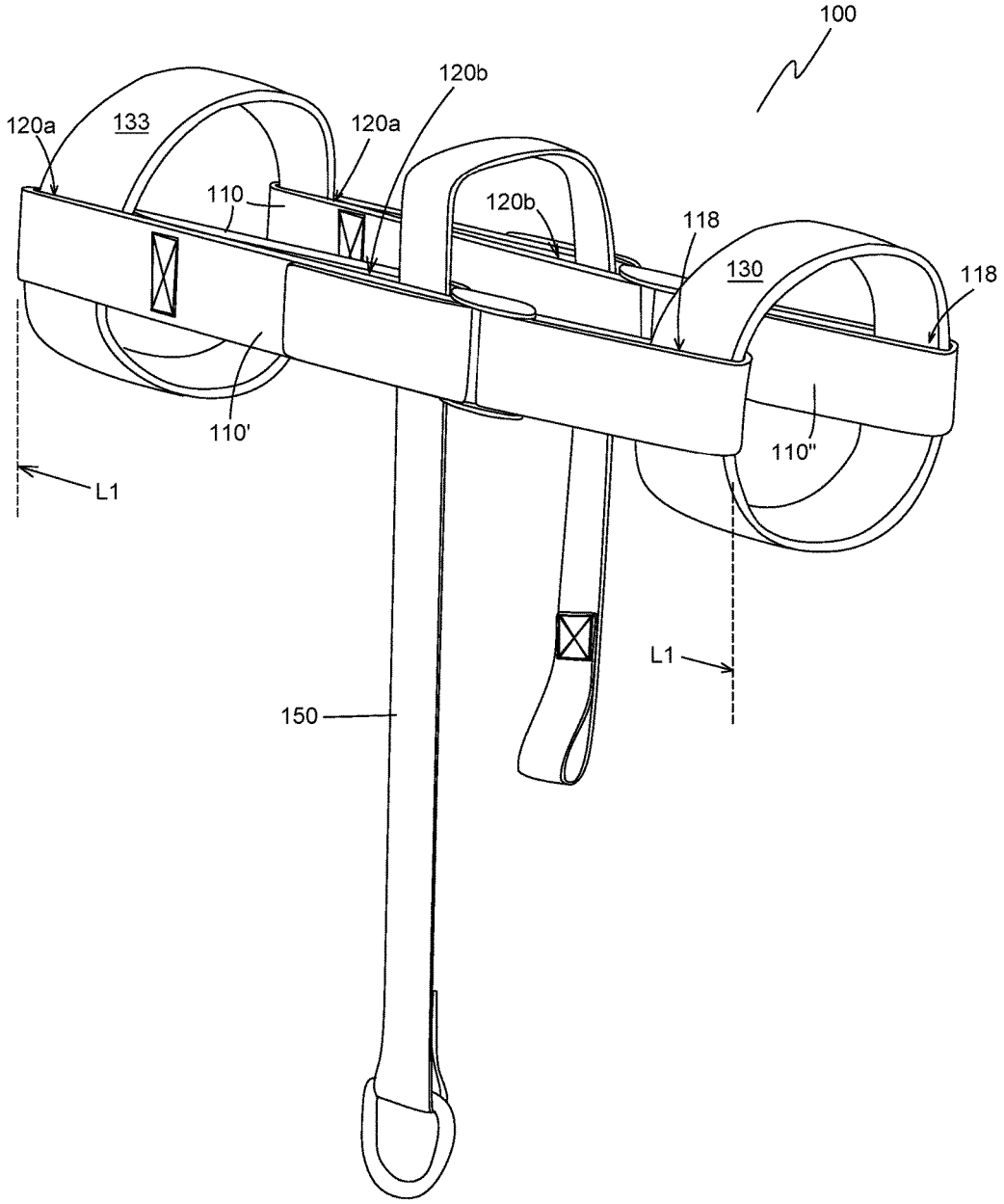
FIG. 10 is a front, top, and side perspective illustration of another embodiment of a tool harness of the present invention that includes a rear sleeve member and first and second tool body straps.

Referring now to FIG. 10, another embodiment of tool harness 100 is illustrated in a top, front, and right-side perspective view. In this embodiment, each of first tool body strap 110' and second tool body strap 110" has an adjustable length L1 as discussed above with reference to FIG. 3. Sleeve member 130 (also referred to as a front sleeve member 130) extends through front loop openings 118 and a rear sleeve member 133 extends through and is captured by rear loop openings 120. Alternately, rear sleeve member is secured to tool body straps 110', 110" by stitching or other means. Tether strap 150 also extends through rear loop openings 120. In one embodiment, tether strap 150 is positioned in rear loop openings 120 to be forward of rear sleeve member 133 and substantially aligned with hand grip 12 of pistol-grip hand tool 10 (shown in FIGS. 11-14).

Length L1 of tool body straps 110', 110" can be adjusted, thereby adjusting a size of rear loop openings 120. Accordingly, the user may increase or decrease the spacing between tether strap 150 and rear sleeve member 133. Optionally, rear loop opening 120 is divided into a first rear loop opening 120*a* and a second rear loop opening 120*b*, where rear sleeve member extends through first rear loop opening

120*a* and tether strap 150 extends through second rear loop opening. In such an embodiment, only one of first or second rear loop opening 120*a*, 120*b* is adjustable. Preferably, second rear loop opening 120*b* is adjustable and first rear loop opening 120*a* is permanently closed around rear sleeve member 133.

In some embodiments, rear sleeve member 133 is a length of webbing that has an adjustable fit around tool body 14; in other embodiments, rear sleeve member 133 is made of heat-shrink tubing, cold-shrink tubing, or rubber tubing that snugly engages housing body 14. When rear sleeve member 133 is adjustable, it may be removed and installed along with adjustment to length L1 of tool body straps 110', 110" as needed to fit the geometry of pistol-grip hand tool.

Figure 11:
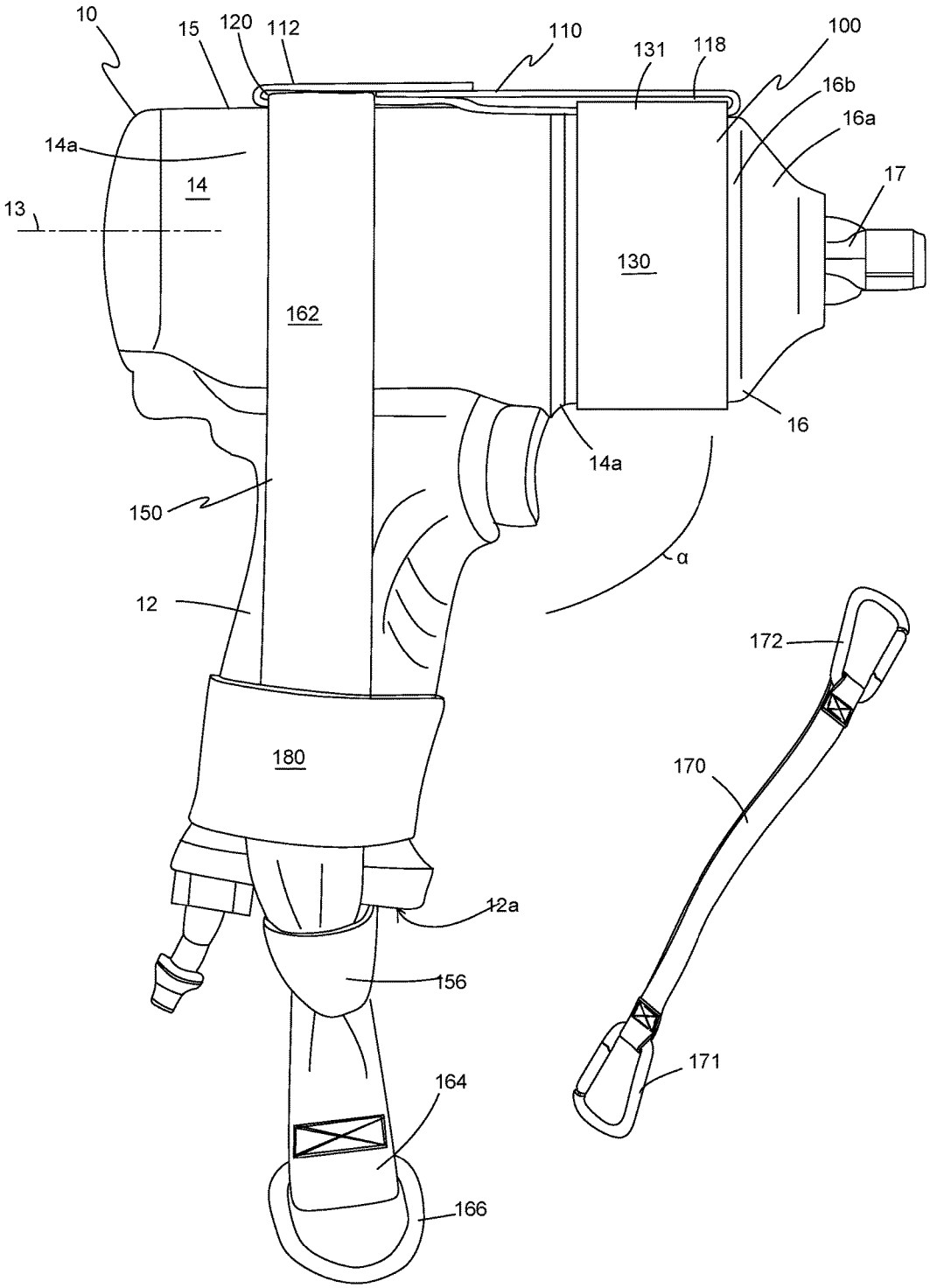
FIG. 11 is a right-side elevational view of the tool harness of FIG. 1 shown installed on one embodiment of a pistol-grip hand tool with the tether strap cinched around the bottom surface of the hand grip.
Figure 12:
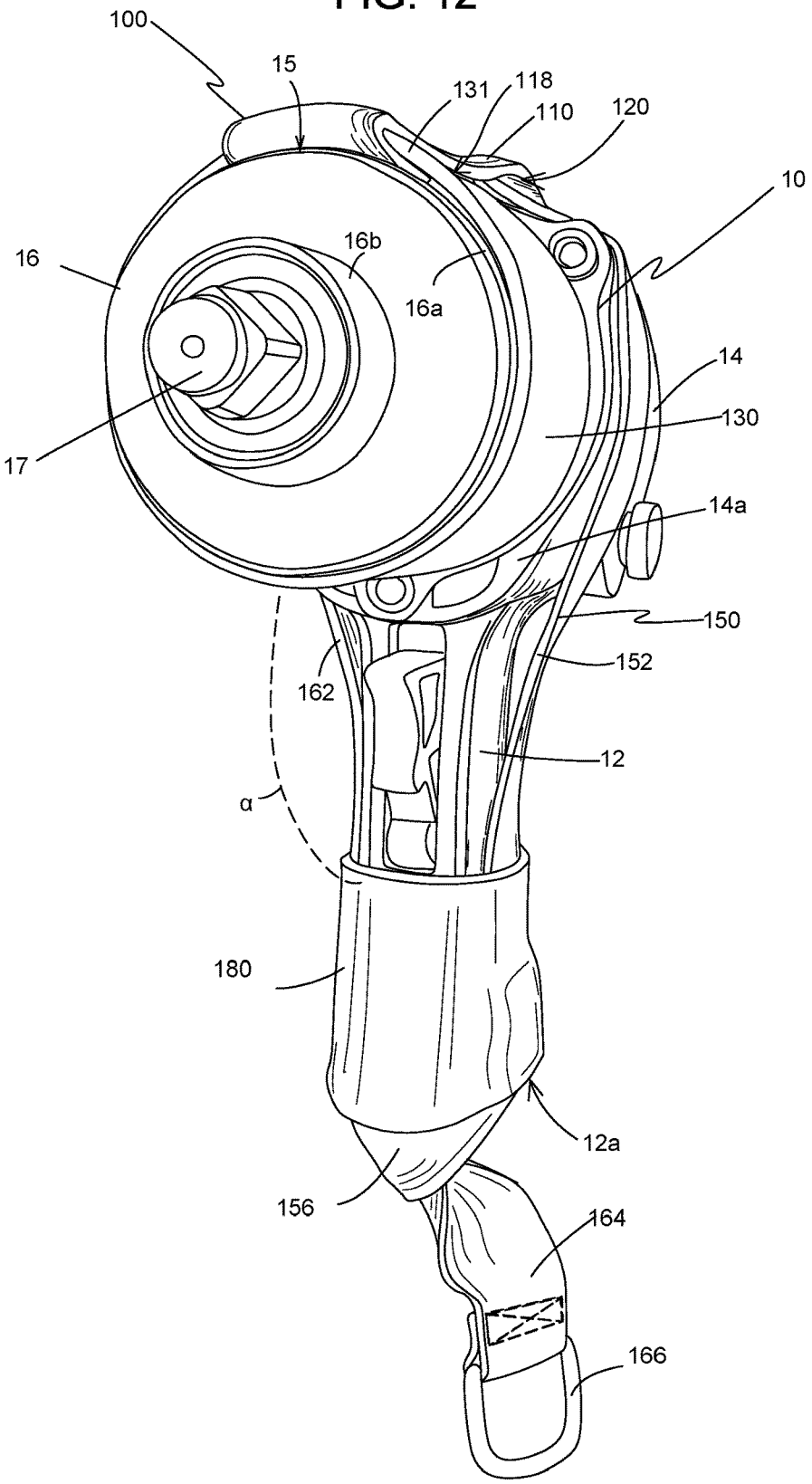
FIG. 12 is a front and left-side perspective view illustration of the tool harness of FIG. 1 installed on another embodiment of a pistol-grip hand tool with the optional handle band installed over the hand grip and first and second tether strap portions.

Turning now to FIGS. 11 and 12, the embodiment of tool harness 100 of FIG. 1 is shown installed on two examples of pistol-grip hand tool 10. In both of FIGS. 10 and 11, pistol-grip hand tool 10 is a pneumatic impact wrench with tool body 14 extending along tool body axis 13 and with hand grip 12 extending transversely down from tool body 14 at an angle $\alpha$ of about 100° with respect to tool body axis 13. In its customary orientation, tool body axis 13 is generally horizontal. Gear housing 16 is part of or attaches to forward portion 14*a* of tool body 14. Gear housing 16 includes a cylindrical housing section 16*a* and a housing tip section 16*b* that opens to a rotating tool head 17. Housing tip section 16*b* may be tapered as shown in FIG. 11, may be a region of reduced diameter as shown in FIG. 12, or may have some other shape.

Tool harness 100 is installed on pistol-grip hand tool 10 with tool body strap 110 extending along top surface 15 of tool body 14. Sleeve member 130 snugly wraps around and conforms to cylindrical housing section 16*a* of gear housing 16. Top wall 131 of sleeve member 130 extends through and is captured by front loop opening 118 of tool body strap 110. Tether strap 150 extends through and is captured by rear loop opening 120 and extends over top surface 15 of pistol-grip hand tool 10 with first and second tether strap portions 152, 162 extending down along opposite lateral sides of hand grip 12. Second tether strap end portion 164 passes through first closed loop 156 of first tether strap end portion 154 and is pulled tight or cinched so that first closed loop 156 is positioned against bottom end 12*a* of hand grip 12. After second tether strap portion 162 passes through first closed loop 156, second closed loop 166 (a D-ring) is available for connection to first tether end 171 or second tether end 172 of a tether 170.

In one embodiment, tether strap 150 is secured to rearward end portion 112 of tool body strap 110, such as by stitching. This configuration provides predefined lengths for first and second tether strap portions 152, 162. In one embodiment, first tether strap portion 152 has a predefined length so that first tether strap portion 152 extends along hand grip 12 with first closed loop 156 beginning approximately at or just below bottom end 12*a* of hand grip 12. Accordingly, second tether strap end portion 164 extends through first closed loop 156 and can be pulled tight so that first closed loop 156 abuts bottom end 12*a* of hand grip 12. In other embodiments, tether strap 150 is not secured to rearward end potion 112, but instead is allowed to slide through rear loop opening 120 of tool body strap 110 so that the lengths of first and second tether strap portions 152, 162 can be adjusted as needed. Accordingly, first closed loop 156 can be positioned against bottom end 12*a* of hand grip 12 when second tether strap portion 162 extends through first closed loop 156.

As shown in FIGS. 11-12, optional handle band 180 is a length of shrink tubing that has been placed over hand grip 12 and tether strap 150 in a pre-shrink or expanded state and then caused to assume a reduced size to snugly engage hand grip 12 and tether strap 150, depending on whether the shrink tubing is heat-shrink or cold-shrink tubing. As discussed above, handle band 180 may alternately be a strap or length of tape that is wrapped tightly around hand grip 12 and tether strap 150.

Figure 13:
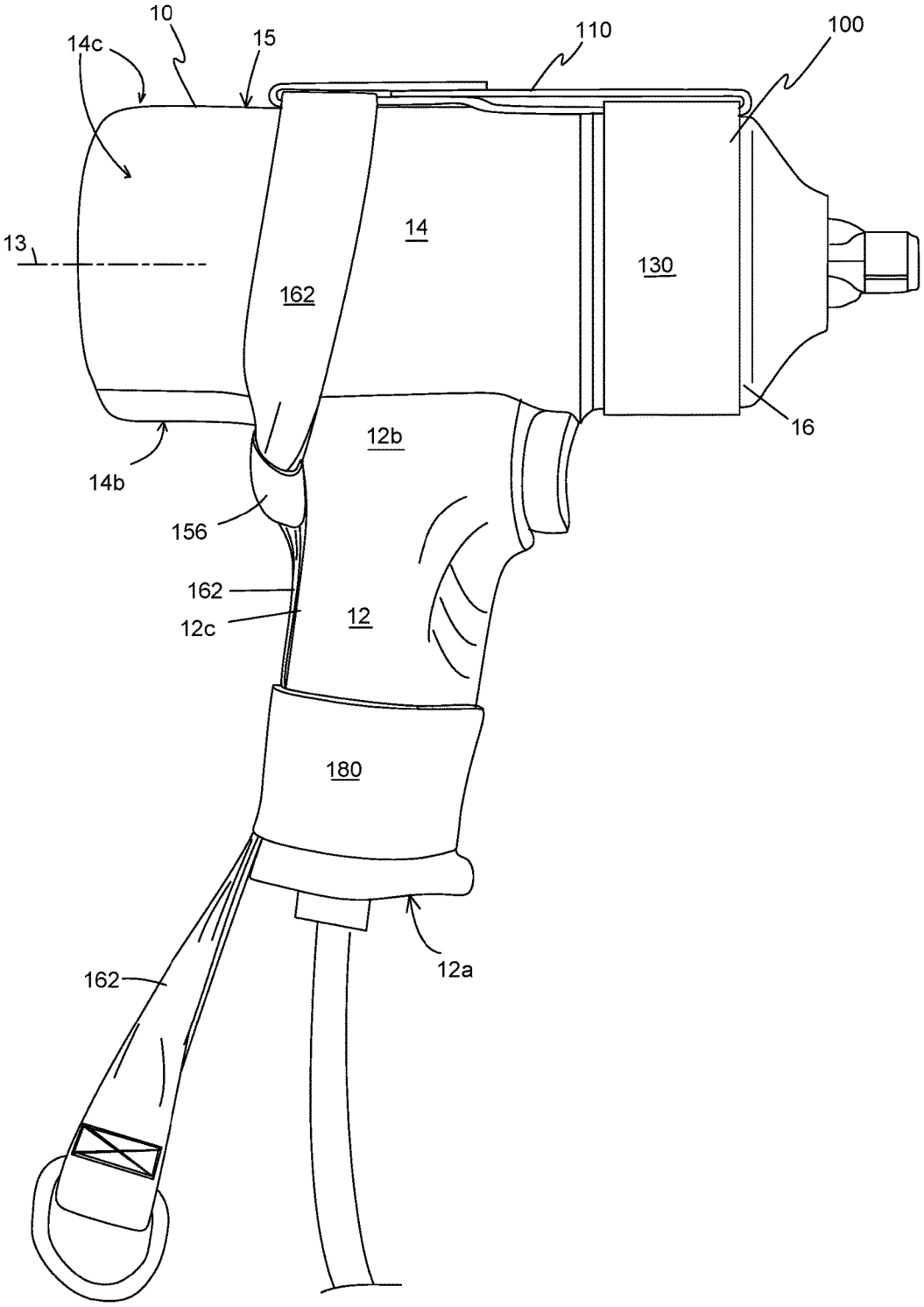
FIG. 13 is a right-side elevational view of an embodiment of a tool harness shown installed on a pistol-grip hand tool with the tether strap cinched around the tool body, the second tether strap portion extending along the rear surface of the hand grip, and a handle band installed over the hand grip and second tether strap portion.

Referring now to FIG. 13, tool harness 100 is shown installed on pistol-grip hand tool 10 in another configuration. Sleeve member 130 is installed on gear housing 16 as discussed above. Tool body strap 110 extends along top surface 15 of tool housing 14. First tether strap portion 152 (not visible) and second tether strap portion 162 extend down along opposite side surfaces 14*c* of tool body. With second tether strap portion 162 passed through first closed loop 156, tether strap 150 is cinched around tool body 14 adjacent base 12*b* of hand grip 12. Second tether strap portion 162 then continues down along a rear surface 12*c* of hand grip 12 and through handle band 180, which wraps around hand grip 12. Such an attachment configuration is useful when bottom surface 12*a* of hand grip 12 does not provide a geometry suitable for cinching tether strap 150. Another benefit of this attachment configuration is that the number of straps extending along hand grip 12 is reduced, therefore reducing the amount of grip size increase for the user due to tether strap 150 and handle band 180 (when present).

Figure 14:
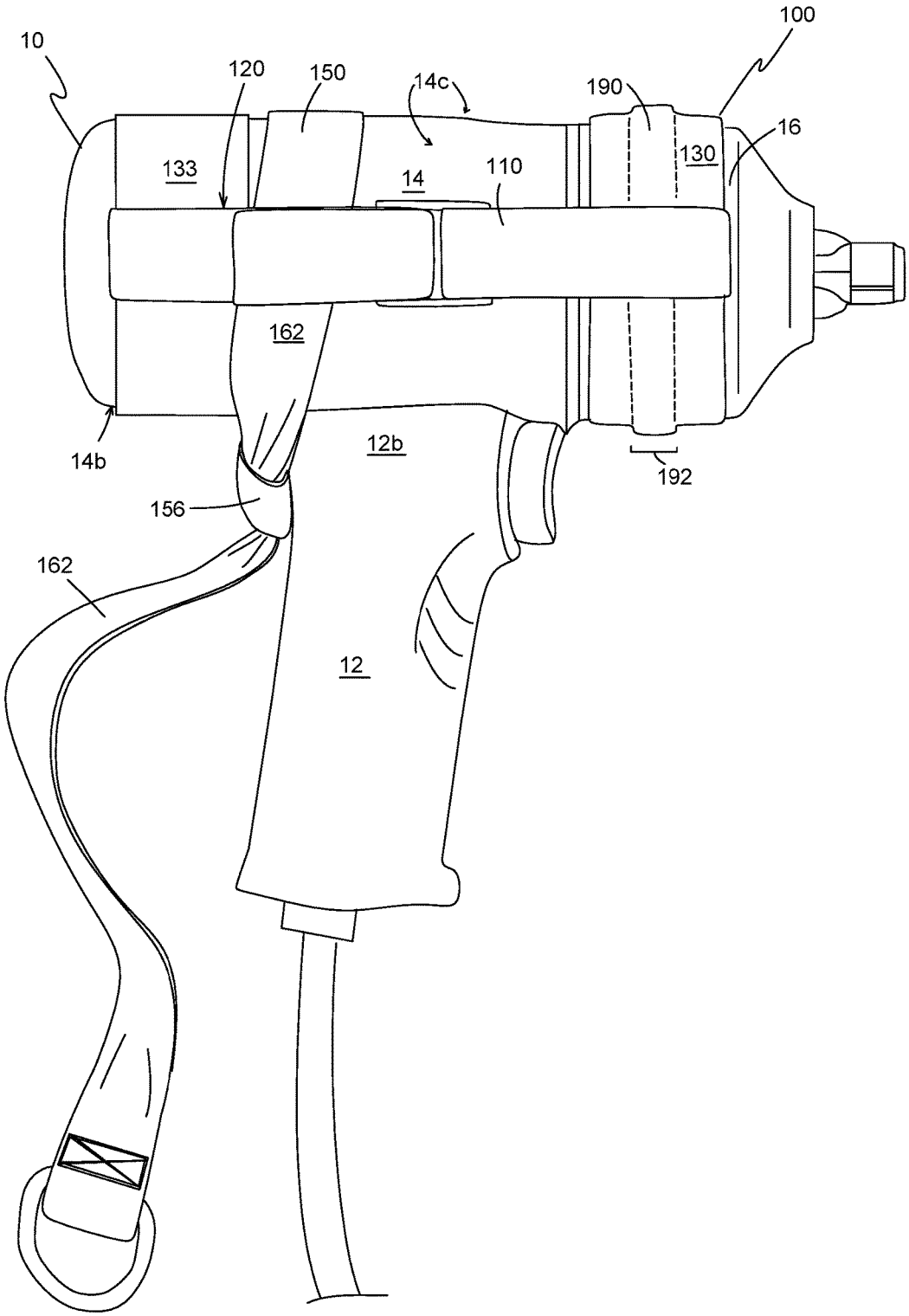
FIG. 14 is a right-side elevational view of another embodiment of a tool harness of the present invention shown installed on a pistol-grip hand tool with the sleeve member installed on the gear housing, the rear sleeve member installed on the tool body, tool body straps extending along opposite side surfaces of the tool body, and the tether strap cinched around the tool body.

Referring now to FIG. 14, tool harness 100 of FIG. 10 is shown installed on pistol-grip hand tool 10, where tool harness 100 includes rear sleeve member 133. A plurality of overlapping layers of tape have been applied to gear housing 16 in a taped region 192. As shown, taped region 192 defines a built-up region 190 (or "geometry") on gear housing 16. For example, geometry 190 is created by 2-4 overlapping layers of self-amalgamating tape or other tape that adheres to gear housing 16. As such, sleeve member 130 better grips gear housing 16.

First tool body strap 110' and second tool body strap 110" (not visible) extend along opposite side surfaces 14*c* of tool body 14. Rear loop opening 120 of each tool body strap 110 captures rear sleeve member 133 and tether strap 150 with tether strap 150 positioned forward of rear sleeve member 133. Second tether strap portion 162 extends through first closed loop 156 of first tether strap portion 152 and is cinched tight against the bottom surface 14*b* of tool body 14 adjacent base 12*b* of hand grip 12. Rear sleeve member 133 is installed around tool body behind hand grip 12. First and second tool body straps 110', 110" extend along opposite side surfaces 14*c* of tool body 12 and prevent sleeve member 130 and rear sleeve member 133 from slipping off of pistol-grip hand tool 10. Since tool harness 100 is secured to pistol-grip hand tool 10 by sleeve member 130, rear sleeve member 133, and tool body straps 110', 110", second tether strap portion 162 extends unsecured from hand grip 12 without the need for handle band 180. Thus, the size of hand grip 12 is not altered by installing tool harness 100.

Figure 15:
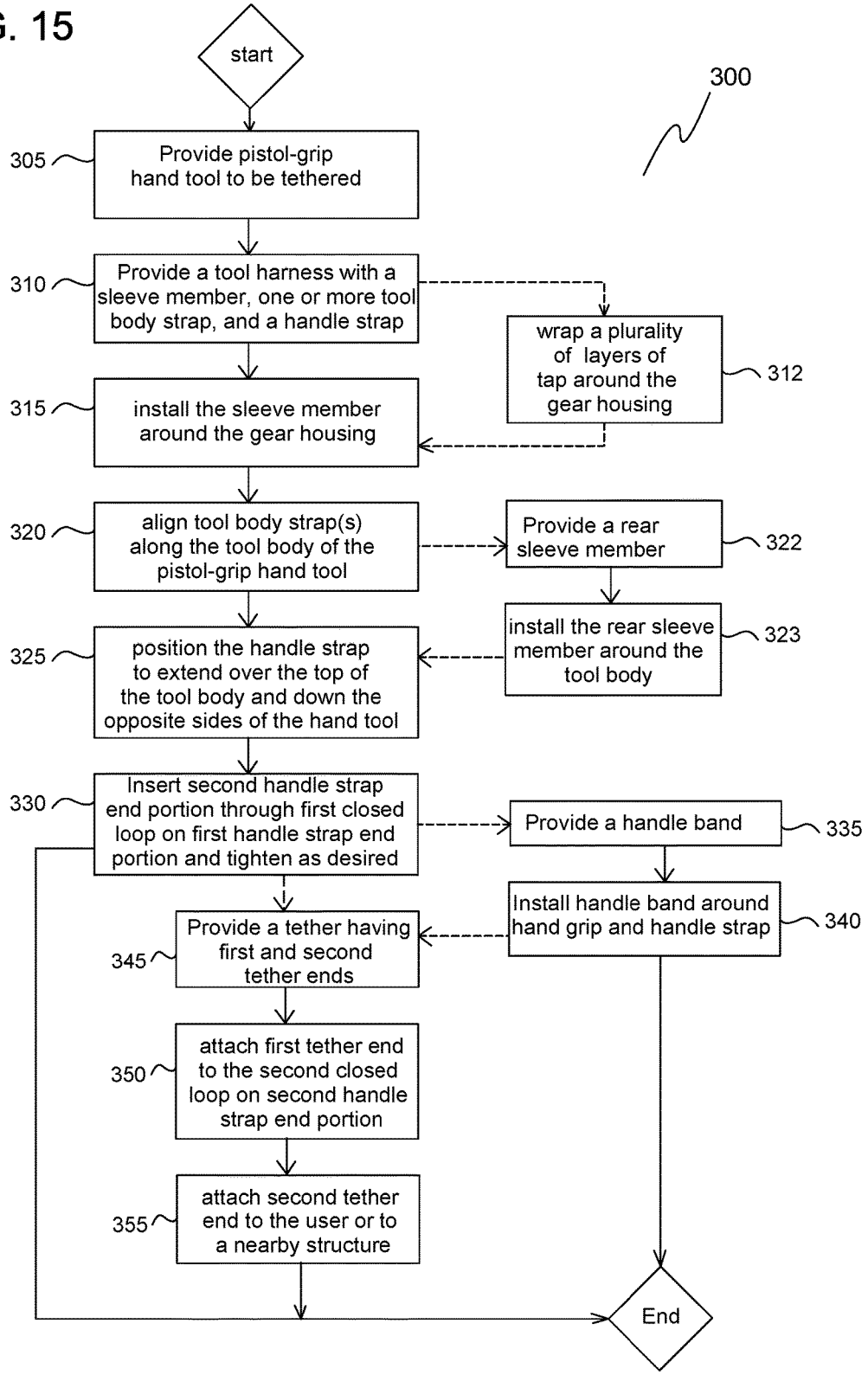
FIG. 15 is a flow chart illustrating steps of one embodiment of a method of tethering a pistol-grip hand tool of the present invention.

Referring now to FIG. 15, a flow chart illustrates steps in one exemplary embodiment of a method 300 of tethering a pistol-grip hand tool 10. The flowchart of FIG. 15 suggests one sequence of performing steps of method 300, however, the steps may be performed in a different order as appropriate or necessary.

In step 305, a pistol-grip hand tool 10 is provided, where pistol-grip hand tool 10 has tool body 14 extending along tool body axis 13, gear housing 16 on a forward end 14*a* of the tool body 14, and hand grip 12 extending transversely down from tool body 14. Typically, hand grip 12 and tool body axis 13 define an angle α from 90-115 degrees. When angle α is greater than 90°, hand grip 12 is canted rearward with respect to forward end 14*a* of tool body 14. More commonly, angle α is from 90-100 degrees. In some embodiments, pistol-grip hand tool 10 is an impact wrench, drill, or other tool powered by compressed air, hydraulic fluid, or electricity.

In step 310, a tool harness 100 for drop prevention is provided, where the tool harness 100 includes a sleeve member 130 constructed to be installed around the gear housing 16 of the pistol-grip hand tool 10, one or more tool body strap 110 defining a flattened closed loop that captures wall 131 of the sleeve member 130, and a tether strap 150 connected to the rearward end portion 112 of the tool body strap(s) 110.

In embodiments where tool body strap 110 extends along the top surface 15 of the tool body 14, tether strap 150 has a first tether strap portion 152 extending down from a first side 110*a* of the tool body strap 110 to a first tether strap end portion 154 defining a first closed loop 156. Tether strap 150 also has a second tether strap portion 162 extending down from a second side 110*b* of the tool body strap 110 to a second tether strap end portion 164 defining a second closed loop 166. The first closed loop 156 is sized to permit passage therethrough by the second tether strap end portion 164.

In embodiments where tool harness 100 includes first tool body strap 110' and second tool body strap 110", first and second tether strap portions 152, 162 connect to respective first and second tool body straps 110', 110" by extending through rear loop openings 120 or by being secured to rearward end portions 112.

In optional step 312, a plurality of overlapping layers of tape are wrapped around the gear housing prior to installing the sleeve member 130. In some cases, sleeve member 130 may not adequately grip gear housing 16. To overcome this problem, a plurality of layers of tape are wrapped around the surface of the gear housing 16 to build built-up region 190 or geometry 190, which sleeve member 130 can engage when installed. In one embodiment, the tape is self-amalgamating or self-fusing tape made of silicone rubber, EPDM, ethylene propylene rubber (EPR), amalgamating butyl rubber, or polyisobutylene (PIB) amalgamating tape. One example of self-amalgamating tape is a mil spec reinforced silicone rubber tape meeting MIL-I-22444 specification as available, for example, from AB Thermal Technologies. The mil spec reinforced silicone rubber tape has a sinusoidal reinforcement fiberglass substrate for added strength and a tape width of about one inch. Other embodiments of self-amalgamating silicone rubber tape are non-reinforced. Another example of self-amalgamating tape is made by Arlon Silicone Technologies of Baer, Del., who makes a fully cured fusible silicone rubber tape with a 25% sinusoidal fiberglass substrate, a width of one inch, a thickness of about 1/32 inch, a tensile strength of 70 PSI, an elongation of 38%, a durometer of 50, an adhesion strength of 6 lb./inch, and meeting MIL-I-22444-C.

In other embodiments, the tape is any tape that increases the friction of the gear housing 16 so that the sleeve member 130 better grips the gear housing 16 (and the tape). Acceptable varieties of tape include duct tape, vinyl adhesive tape, polyurethane cushioned grip tape, cloth tape with tacky surfaces (a.k.a. hockey tape), cloth tape as used for sports training and medicine, strapping tape, electrical tape, polymer handlebar tape (e.g., Lizard Skins™ bicycle handlebar tape) and the like. In one embodiment, applying tape to the gear housing 16 is performed by wrapping a continuous length of tape in a spiral along the portion of gear housing 16 where sleeve member 130 will be installed. In some embodiments, each successive layer of tape overlaps the previous layer by about 50% as it is wrapped in a spiral along the gear housing 16. More or less overlap is acceptable. In other embodiments, individual lengths of tape about equal in length to the circumference of the gear housing 16 are wrapped circumferentially around the gear housing 16 and positioned substantially parallel to one another and in close proximity, in axial abutment, or overlapping one another. In the embodiments where self-amalgamating or self-fusing tape is used, the tape is stretched during application onto the gear housing 16, where stretching the tape activates the self-amalgamating properties.

In one embodiment, the taped portion of gear housing 16 is equal to or greater than the length L2 of sleeve member 130. In another embodiment, the taped portion of the gear housing 16 has a length less than L2. As an example, the tape is wrapped around the gear housing 16 in a single, overlapping spiral path to result in taped portion of the gear housing 16 with a single thickness of the tape except where edges overlap. In another example, the tape is wrapped 2-4 times around the gear housing 16 in a single, overlapping path to create a built-up region 190 or "geometry" 190 on gear housing 16. When sleeve member 130 is heat-shrink or cold-shrink tubing, for example, and sleeve member 130 is applied over the taped region 192 or over the geometry 190 created by the tape, the sleeve member 130 has an improved grip on the gear housing 16.

In step 315, sleeve member 130 is installed around gear housing 16 of the pistol-grip hand tool 10. When sleeve member 130 is heat-shrink tubing or cold-shrink tubing, step 315 includes causing sleeve member 130 to assume a reduced size so that it snugly engages and grips gear housing 16. When sleeve member 130 is heat-shrink tubing, for example, installation includes heating the heat-shrink tubing, causing sleeve member 130 to shrink to a smaller size and conform to the size and shape of the gear housing 16. In embodiments, where sleeve member 130 is made of rigid materials, such as a plastic tube, sleeve member 130 is installed by fitting over gear housing 16 or inserting gear housing 16 into sleeve member 130.

In step 320, the tool body strap(s) 110 is (are) extended along tool body 14 of pistol-grip hand tool 10. In one embodiment, tool body strap 110 is aligned to extend along top surface 15 of pistol-grip hand tool 10. Alternately, or in addition, first tool body strap 110' and second tool body strap 110" are aligned to extend along opposite side surfaces 14*c* of tool body 14.

In optional step 322, a rear sleeve member 133 is provided, where rear sleeve member 133 is constructed to wrap around tool body 14. In step 323, rear sleeve member 133 is installed around tool body 14. For example, rear sleeve member 133 is cold-shrink tubing that is installed on the rear portion of tool body 14 behind hand grip 12. Optionally, length L1 of each tool body strap 110', 110" is adjusted as needed to remove excess slack.

In step 325, first tether strap portion 152 and second tether strap portion 162 are positioned to extend over top surface 15 of pistol-grip hand tool 10 and down from tool body strap(s) 110 along opposite lateral sides of tool body 14. In one embodiment, first and second tether strap portions 152, 162 extend along opposite lateral sides of hand grip 12 of the pistol-grip hand tool 10.

In step 330, the second tether strap end portion 164 is inserted through the first closed loop 156 on the first tether strap end portion 154. Optionally and as needed, second tether strap portion 162 is pulled tight, or cinched. In one embodiment, tether strap 150 is cinched so that first closed loop 156 abuts bottom end 12*a* of hand grip 12. In another embodiment, tether strap 150 is cinched against bottom surface 14*b* of tool body adjacent base 12*b* of hand grip 12.

In one embodiment, method 300 also includes optional steps 335 and 340. In step 335, a handle band 180 is provided, where handle band 180 is sized and constructed to be installed around and tightened on tether strap 150 and hand grip 12 portion of the pistol-grip hand tool 10. In step 340 handle band 180 is installed around the hand grip 12 with the tether strap 150 extending along the hand grip 12, where the first tether strap portion 152 and/or the second tether strap portion 162 extends between the hand grip 12 and the handle band 180. During installation, handle band 180 is tightened on hand grip 12 to restrict movement of first tether strap portion 152 and the second tether strap portion 162 as well as to avoid overly increasing the size of hand grip 12.

In one embodiment of method 300, handle band 180 is selected as shrink tubing, rubber tubing provided in an expanded state over a removable core, an adjustable strap, a length of self-amalgamating tape, or a length of adhesive tape. In an embodiment where handle band 180 is rubber tubing provided in the expanded state (i.e., "cold-shrink tubing"), step 340 of installing the handle band 180 includes removing the removable core to allow the rubber tubing to assume a reduced size and snugly grip and conform to the hand grip 12 and tether strap 150.

In another embodiment, method 300 also includes steps 345, 350, and 355. In step 345, a tether 170 is provided where the tether 170 has a first tether end 171 and a second tether end 172. In step 350, the first tether end 171 is connected to the second closed-loop on the second handle-strap end portion. In step 355, the second tether end 172 is connected to the user or to a nearby structure.

In use, embodiments of tool harness 100 provide reliable tethering attachment for pistol-grip hand tools 10. Tool harness 100 is particularly suited for pistol-grip hand tools 10 having a weight of five pounds or more. By using embodiments of tool harness 100 to tether pistol-grip hand tool 10, safety is improved and the risk of damage or personal injury is reduced.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A drop-prevention tool harness for a pistol-grip hand tool having a tool body and a hand grip, the drop-prevention tool harness comprising:

a front sleeve member extending about a central sleeve axis, wherein the front sleeve member has a sleeve wall and defines an opening sized to be installed around a gear housing of a pistol-grip hand tool;

one or more tool body straps defining a flattened closed loop that extends around and captures the sleeve wall, wherein each of the one or more tool body straps extends to a rearward end portion spaced apart from the front sleeve member in a direction generally parallel to the central sleeve axis;

a tether strap with a middle portion connected to the rearward end portion of each of the one more tool body straps and having a first tether strap portion extending down from the middle portion to a first tether strap end portion defining a first closed loop and a second tether strap portion extending down from the middle portion to a second tether strap end portion defining a second closed loop, wherein the first tether strap portion and the second tether strap portion extend transversely from the one or more tool body straps in generally a spaced-apart relation, and wherein the first closed loop is sized to permit passage therethrough by at least a portion of the second tether strap end portion to secure the tether strap about the pistol-grip hand tool, the second closed loop configured and arranged to receive a tether connector; and a handle band configured to extend about a band axis, wherein the handle band defines an opening sized to be installed around a hand grip of the pistol-grip hand tool and configured to be installed around both of the first tether strap portion and the second tether strap portion, wherein the handle band is spaced apart from the front sleeve member and the one or more tool body straps and does not intersect the central sleeve axis.

2. The drop-prevention tool harness of claim 1 wherein the handle band is configured to be installed snugly around the tether strap and the hand grip of the pistol-grip hand tool when the tool harness is installed on the pistol-grip hand tool with each of the one or more tool body straps extending along a tool body of the pistol-grip hand tool and the first tether strap portion and second tether strap portion each extending down along opposite sides of the hand grip.

3. The drop-prevention tool harness of claim 1, wherein the one or more tool body straps includes a first tool body strap configured to extend along a first side surface of the tool body and a second tool body strap configured to extend along an opposite second side surface of the tool body.

4. The drop-prevention tool harness of claim 3, wherein the first tool body strap and the second tool body strap each define a rear loop opening, and wherein the tool harness further comprises a rear sleeve member spaced apart from and generally coaxial with the front sleeve member, wherein the rear sleeve member extends through the rear loop opening of the first tool body strap and of the second tool body strap.

5. The drop-prevention tool harness of claim 4, wherein each rear loop opening is adjustable.

6. The drop-prevention tool harness of claim 4, wherein the tether strap is positioned along the central sleeve axis between the front sleeve member and the rear sleeve member.

7. The drop-prevention tool harness of claim 1, wherein each of the one or more tool body straps defines a rear loop opening and wherein the tether strap extends through the rear loop opening of each of the one or more tool body straps.

8. The drop-prevention tool harness of claim 1, wherein the handle band is a strap fixedly attached to and extending transversely from the first tether strap portion or the second tether strap portion, wherein the handle band is positioned along the first tether strap portion or the second tether strap portion to be wrapped around the hand grip of the pistol-grip hand tool when the tool harness is installed on the pistol-grip hand tool with the tool body strap extending along the tool body of the pistol-grip hand tool and the tether strap extending over a top surface of a tool body with the first tether strap portion and second tether strap portion each extending down along the hand grip.

9. The drop-prevention tool harness of claim 1, wherein the tether strap is fixedly secured to the rearward end portion of each of the one or more tool body straps.

10. The drop-prevention tool harness of claim 9, wherein, when installed on a pistol-grip hand tool with the one or more tool body straps extending along a tool body of the pistol-grip hand tool, the first tether strap portion is sized to extend from a top surface of the tool body and down along the hand grip with the first closed loop located adjacent a bottom end of the hand grip when the second tether strap end portion passes through the first closed loop.

11. The drop-prevention tool harness of claim 1, wherein the rearward end portion of the tool body strap defines a rear loop opening and wherein the tether strap slidably extends through the rear loop opening, thereby enabling adjustment of a length of the first tether strap portion relative to the second tether strap portion.

12. The drop-prevention tool harness of claim 1, wherein the handle band is positioned between the first closed loop and the tool body strap.

13. The drop-preventing tool harness of claim 1, wherein the handle band forms a loop.

14. The drop-prevention tool harness of claim 1, wherein the handle band is positioned within a loop attached to the second tether strap portion.

15. The drop-prevention tool harness of claim 1, wherein the handle band is fixed to the second tether strap portion.

* * * * *